US007975585B1

(12) United States Patent
Shiban

(10) Patent No.: US 7,975,585 B1
(45) Date of Patent: Jul. 12, 2011

(54) SAW GUARD

(75) Inventor: Samir S. Shiban, Chandler, AZ (US)

(73) Assignee: Innovative Engineering Solutions, Inc., Chandler, AZ (US)

( * ) Notice: Subject to any disclaimer, the term of this patent is extended or adjusted under 35 U.S.C. 154(b) by 503 days.

(21) Appl. No.: 11/810,322

(22) Filed: Jun. 5, 2007

(51) Int. Cl.
*B26D 7/22* (2006.01)

(52) U.S. Cl. ..... 83/440.2; 83/425; 83/447; 83/477.2; 83/478

(58) Field of Classification Search ..... 83/478, 83/477.2, 469, 860, 168, 374, 375, 388, 389, 83/425, 440.2, 446–450, 438; 144/253.1, 144/253.2, 253.6, 286.1, 287
See application file for complete search history.

(56) References Cited

U.S. PATENT DOCUMENTS

| | | | | |
|---|---|---|---|---|
| 2,538,456 | A * | 1/1951 | Howe, Jr. | 83/814 |
| 2,913,926 | A * | 11/1959 | Hammond | 74/612 |
| 4,055,160 | A | 10/1977 | Wilson | |
| 4,576,073 | A | 3/1986 | Stinson | |
| 4,660,448 | A | 4/1987 | Bies | |
| 5,317,944 | A | 6/1994 | Hewitt | |
| 5,662,019 | A | 9/1997 | Denman | |
| 6,418,829 | B1 | 7/2002 | Pilchowski | |
| 6,718,857 | B2 * | 4/2004 | Kimmel et al. | 83/447 |
| 6,886,441 | B2 * | 5/2005 | Hamilton | 83/478 |
| 7,140,286 | B2 * | 11/2006 | Schwartz | 83/446 |
| 7,210,386 | B1 * | 5/2007 | Chang | 83/478 |
| 7,228,773 | B2 * | 6/2007 | Powell | 83/100 |
| 7,299,840 | B1 * | 11/2007 | Moschetti | 144/253.6 |
| 2001/0032534 | A1 * | 10/2001 | Ceroll et al. | 83/473 |
| 2004/0187666 | A1 | 9/2004 | Huang | |
| 2004/0255745 | A1 | 12/2004 | Peot et al. | |
| 2005/0235793 | A1 | 10/2005 | O'Bannion et al. | |
| 2006/0053993 | A1 | 3/2006 | Wong | |

* cited by examiner

*Primary Examiner* — Phong H Nguyen
(74) *Attorney, Agent, or Firm* — James Creighton Wray

(57) ABSTRACT

A table saw guard has opposed rubber fingers extending from opposite supports. The fingers meet near slots in a saw table along a saw slot and provide visual and tactile warning of approaching the saw blade. The fingers bend as a board is pushed into contact with a saw. Friction between the bent fingers and the board resist unwanted bounce-back of the board while being sawed.

3 Claims, 8 Drawing Sheets

SAW GUARD

BACKGROUND OF THE INVENTION

Needs exist for improved saw guards and table saw guards to reduce pusher damage and injuries.

Needs exist for improved anti-bounce-back devices for table saws.

SUMMARY OF THE INVENTION

A table saw guard apparatus has a table and a plate with a saw slot. A saw is connected to the table. A saw blade extends through the slot. A saw guard is connected to the table. The saw guard has mounts mounted near the saw blade and extensions extending from the mounts toward the table along the saw and near a front of the saw. A plate is connected to the table, and the saw slot is in the plate. The plate has at least one guard slot parallel to the saw slot for receiving the extensions. Two guard slots extend parallel to the saw slot and the extensions extend from the mounts into the guard slots.

The mounts are mounted on opposite sides of the saw table, and the extensions extend in opposite directions from the mounts toward the guard slots. The extensions are spaced, flexible and resilient fingers with outer ends fixed in the mounts and aligned free inner ends associated with the guide slots.

A lever is connected between the table and the saw for raising and lowering the saw and the saw blade. The saw also has an electric motor and a speed reducer mounted on the lever opposite the saw blade. The mounts are connected to the lever. Raising and lowering the lever raises and lowers the mounts and the extension with the saw and the saw blade.

A new saw guard apparatus has a saw and a holder adjacent the saw. Resilient, flexible guard fingers extend from the holder adjacent the saw for providing visual and tactile warning of proximity to the saw. The guard fingers are rubber-like.

In one embodiment, the saw is a table saw, and the fingers are positioned on opposite sides of the saw. The table also has a saw slot for receiving the saw.

In one embodiment, the saw is a rotary saw, and the table has guard slots parallel to the saw slot for receiving tips of the guard fingers in the guard slots. Holders are mounted on opposite sides of the table, and the guard fingers are opposed guard fingers and extend from the holders toward the table. Tips of the opposed guard fingers approach each other near the guard slots in the table.

The rotary saw and the holders are interconnected for movement in relation to the table. The table has an extension, and a lever is pivoted on the extension. An adjuster is connected to the lever. The saw and the mounts are connected to the lever for repositioning the saw and the holders and fingers up or down in the slots by moving the lever with the adjuster. A mounting bracket is connected to the lever, and the holders are connected to the bracket. The holder and guard fingers also have four integral comb-like holders and guard fingers having backs connected to the bracket.

A preferred method of guarding a table saw includes positioning flexible guard fingers on opposite sides of a rotary saw blade for contacting the fingers before contacting the saw with items to be cut.

The guard fingers are bent rearward along the saw as items are cut, engaging surfaces of the items with the guard fingers, and resisting bounce-back of the items with the effects of the saw.

A table saw top plate is provided with a saw slot and parallel guard finger slots, and fingers are extended in opposition from opposite sides of a saw table toward and into the guard finger slots.

A lever is pivoted from an extension on the table. The saw and a saw guard mounting bracket are connected to the lever, extending the guard fingers from the mounting bracket. Moving the lever in opposite directions raises and lowers the saw, and mounting bracket and guard fingers with respect to the table.

These and further and other objects and features of the invention are apparent in the disclosure, which includes the above and ongoing written specification, with the claims and the drawings.

The present invention is a table saw guard that has a series of rubber or rubber-like fingers that are mounted in blocks parallel to a circular table saw. The fingers extend toward and through slots in the table along the saw blade slot, specifically along the front of the saw. The rubber fingers provide a visual and tactile reminder of the closeness of a pusher to the saw blade and are intended to protect a user's fingers. The user's sight and sense of touch warn of closeness to the saw blade. The rubber fingers also provide bounce-back protection assistance.

Preferably, the rubber fingers are extended from parallel holders on opposite sides of a saw blade about 1½ inches from the table. The rubber fingers meet in the center of the table. The rubber fingers are flexible. Holders are mounted on a frame which moves up and down with the saw table. Similar fingers extend downward and upward from parallel holders above and below the table. Frames mount the holders along opposite sides of the saw. Upper and lower holders may be moved independently away from the table.

DETAILED DESCRIPTION OF THE PREFERRED EMBODIMENTS

Figure 1:
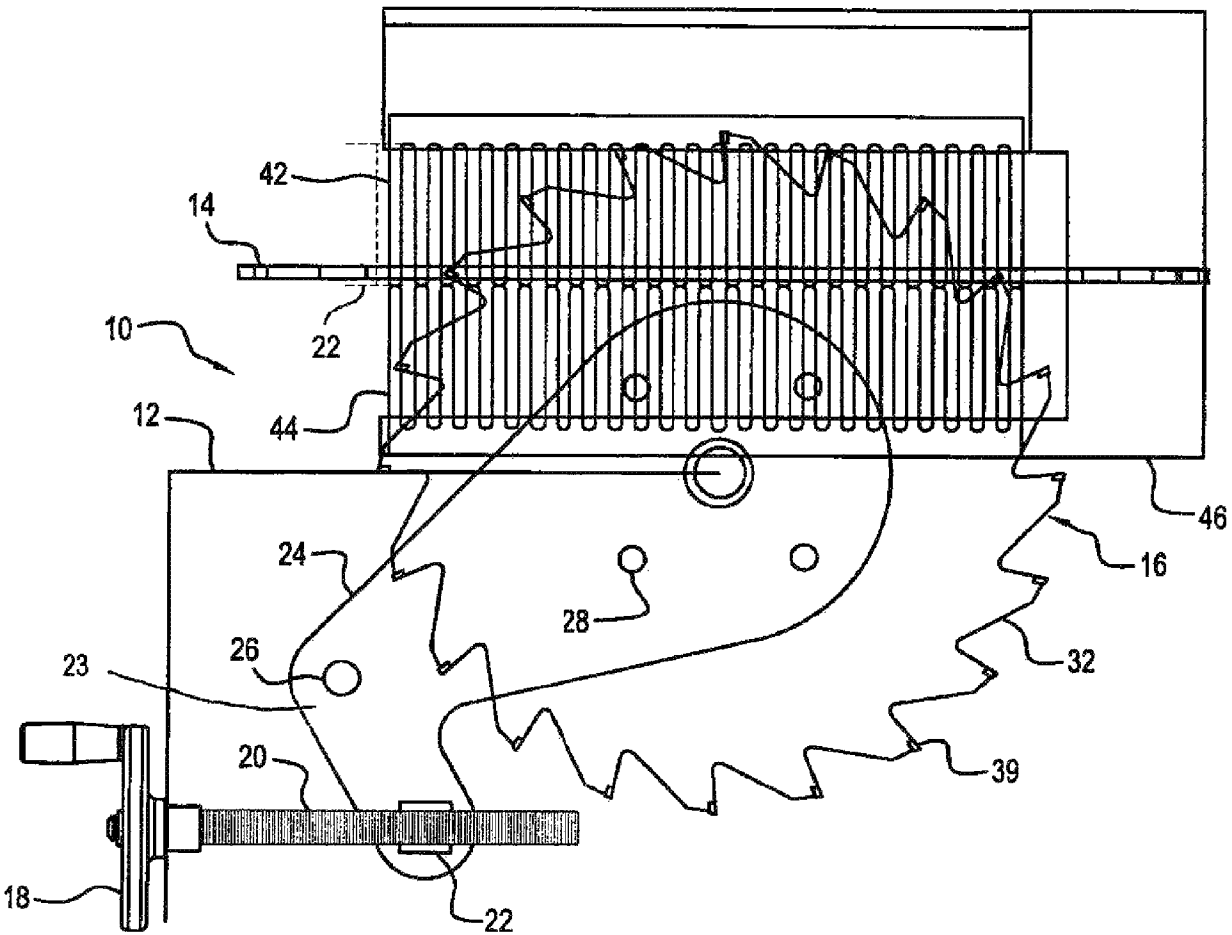
FIG. 1 is a side elevational view of the table saw guard.

Referring to FIG. 1, a table saw is generally indicated by the numeral 10. The table saw has a base 12, on which a saw table with a slotted insert plate 14 and saw assembly 16 are mounted. The table saw assembly 16 can be raised or lowered in the slotted insert plate on the table by turning the wheel 18 and its attached screw 20 in pivoted nut 22. Nut 22 is pivotally connected to one arm 23 of an L-shaped crank lever 24. Turning wheel 18 and screw 20 moves the L-shaped crank lever 24 around a fixed pivot 26. A motor, not shown, is attached to motor mounts 28 and has a shaft extending through the central bearing. A circular saw blade 32 is mounted on the shaft and turns counter clockwise as shown in FIG. 1.

Saw blade 32 with teeth 39 rotates through a central slot 36 in the saw table insert plate 14. The saw table insert plate 14 is fixed to the table on the saw base 12. Articles and boards to be sawed are pushed along the table and across the plate 14 into the path of saw blade 32.

In the present invention, warning fingers assemblies 40 provide tactile and visual warning of approaching the vicinity of the saw blade.

Sets of rubber fingers 42, 44 extend from the C-shaped mounting bracket 46 downward and upward on opposite sides of the saw table and on opposite sides of the saw blade 32. The fingers 42, 44 are about 1½ inches above and below the table. The rubber fingers above and below the table extend into parallel slots 38 along saw slot 36 and meet just below the table as shown in FIG. 1 or approximately at the center 22 of the table insert plate 14.

The warning fingers assemblies 40 are fixed on flanges of C-shaped mounting bracket 46 which is connected to the saw raising and lowering L-shaped lever 24.

As the saw is raised and lowered by the lever 24, in addition to moving the saw up or down through the slot, the attachment of the bracket 46 to the saw axle housing by welding moves the entire warning fingers assembly up and down with the saw in respect to the table. The vertical member of the frame 46 extends through a slot in the table top plate rearward of the saw slot. Those two slots may be continuous. The saw also is tiltable for sloping cuts, up to 45° or more by tilting the saw axle housing. Since the bracket that holds the entire warning fingers assembly is welded to the saw axle housing, the warning fingers assembly tils with the saw. The insert plate 14 remains fixed flat with the saw table. The slots in the insert plate are sufficiently wide to accommodate the tilted saw, the tilted warning fingers and any changes in spacing between the saw and the fingers in the plane of the table.

When the saw is raised and lowered, the warning fingers assembly moves up and down with the saw.

Figure 2:
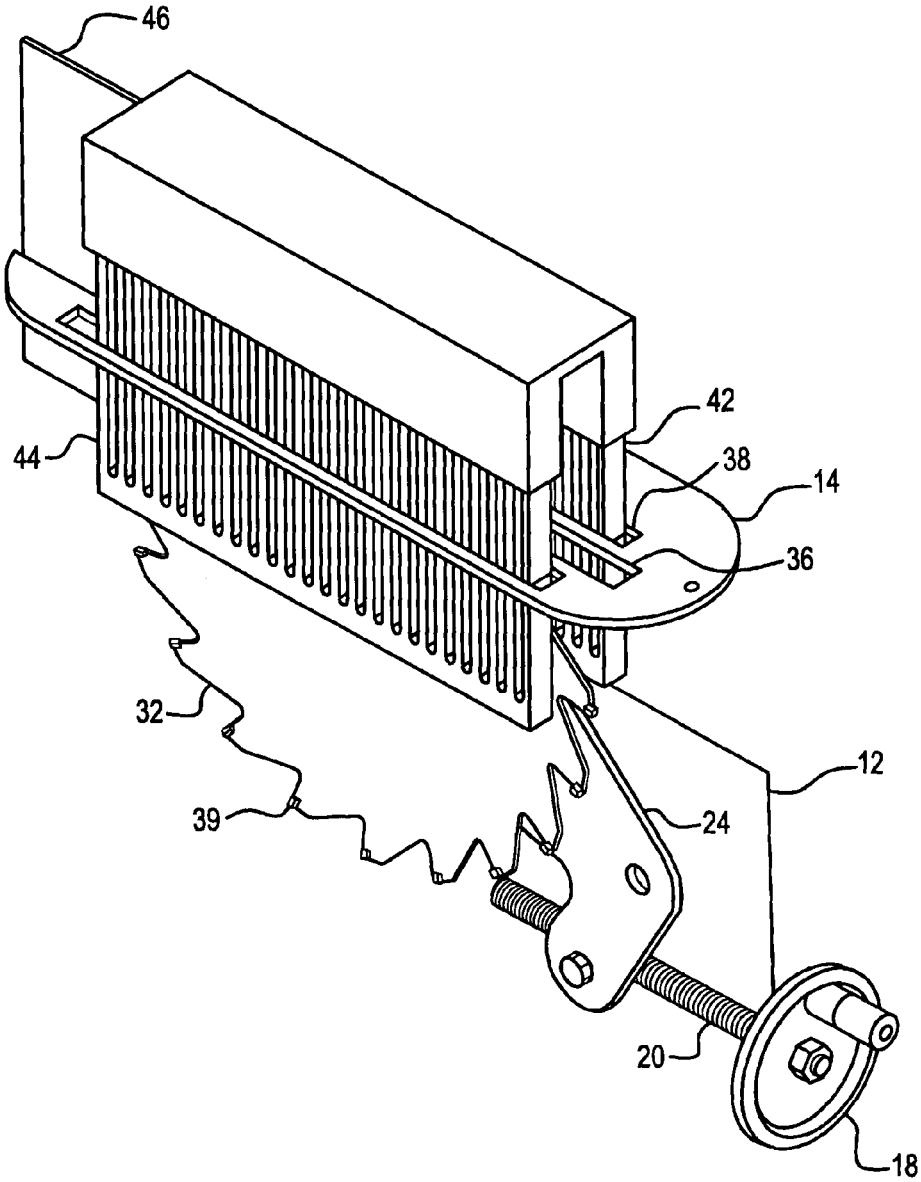
FIG. 2 is a prospective view of table saw guard.
Figure 3:
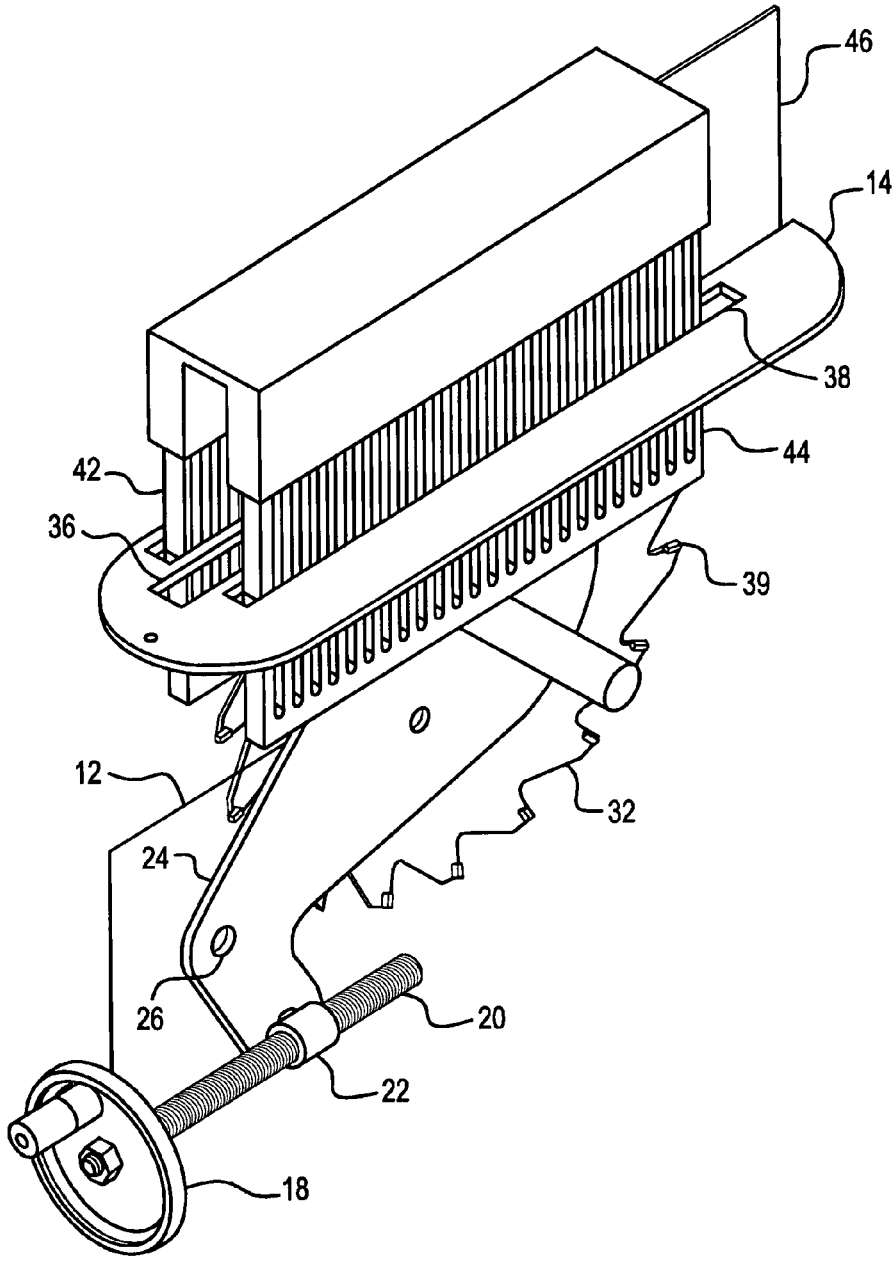
FIG. 3 is an opposite side perspective of the table saw guard.
Figure 4:
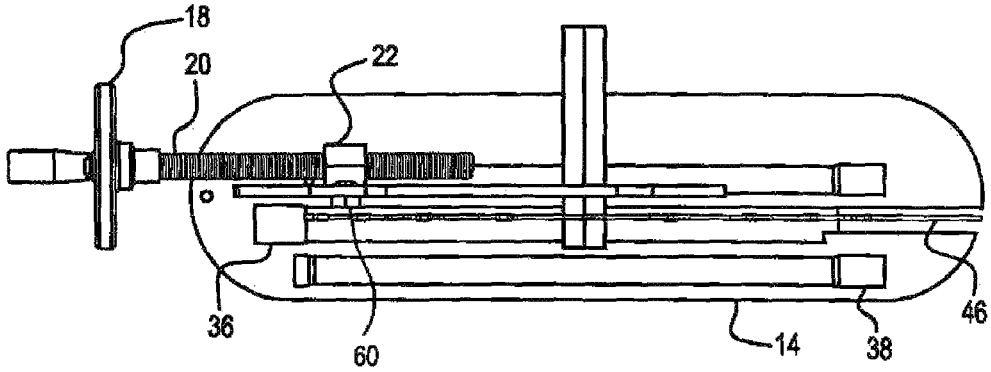
FIG. 4 is a bottom view of the table saw guard.

In FIGS. 2 and 3, four slots are shown in the table top plate 14 that is mounted to the saw table. The saw slot 36 in the middle is for the saw blade. Two parallel side slots 38 are for the rubber fingers 42, 44.

The saw and C-shaped frame 46 are mounted on an axle 52 which extends through the crank lever 24. The crank lever is pivoted on the table saw base 12 with a pin which extends through hole 26 in the lever. Pivoted nut 22 pivots on pin 60. Adjuster screw 20 is turned by wheel 18 to move nut 22 rearward to move crank lever 24 for raising the saw and finger assembly 40. Turning the wheel in the opposite direction draws the nut 22 forward and lowers the saw and finger assembly 40.

Figure 5:
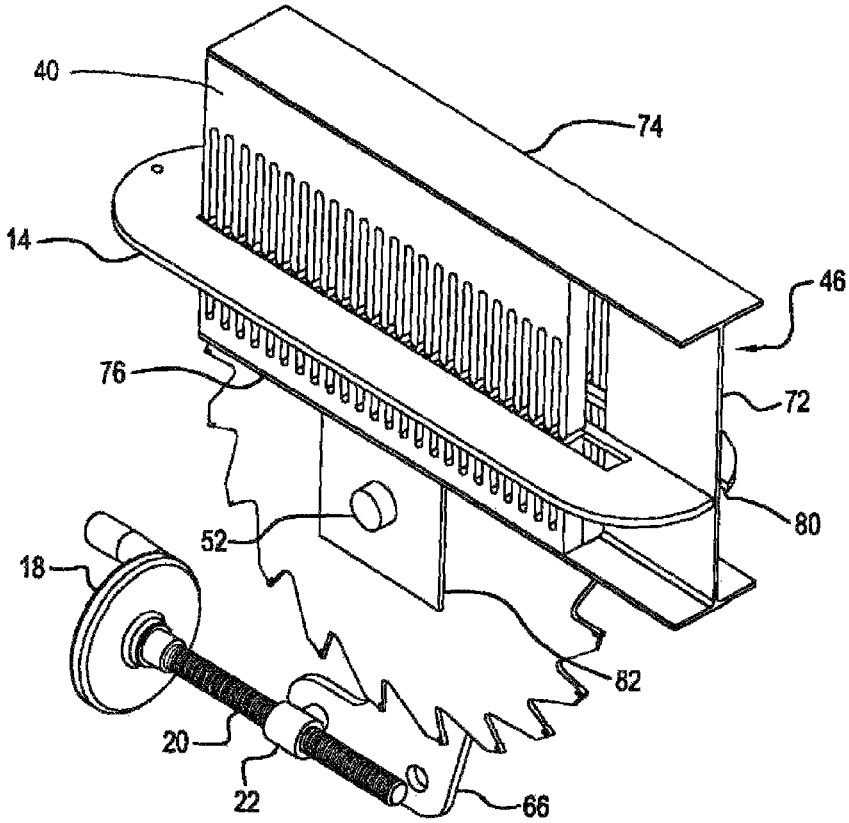
FIG. 5 is a perspective view of the saw guard system using a different crank lever.

FIG. 5 is a rear and top perspective view of the invention with an alternate crank lever 66. The saw guard mounting bracket 46 shown in FIGS. 1-8 and 15-18 is an I-beam configured C-shaped bracket. A strong vertical web 72 has an upper cantilevered flange plate 74. Lower split cantilevered flange plates 76, 68 extend along opposite sides of the saw blade. The I-beam vertical web 72 slides upward and downward in a slot 80 which extends rearward from the saw blade slot. Vertical plate 82 is welded on one of the lower cantilevered flanges 76, 78 and extends downward. Opening 84 in the vertical plate 82 is mounted on the extended axle on which the saw blade rotates.

Figure 6:
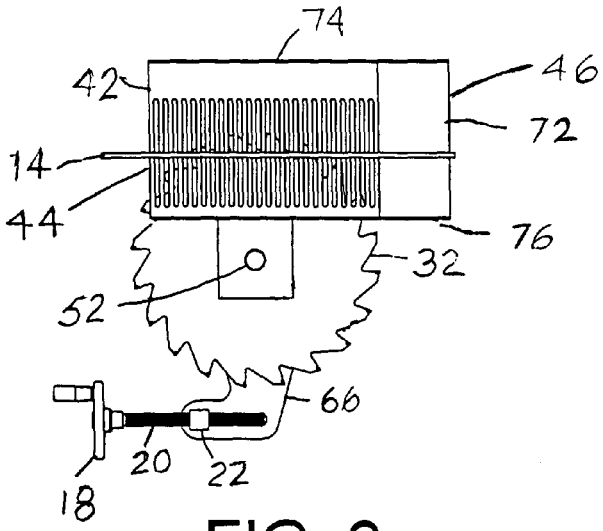
FIG. 6 is a side elevation of the saw guard system shown in FIG. 5.

FIG. 6 is a side elevation similar to FIG. 1, except that the alternate crank lever is employed.

Figure 7:
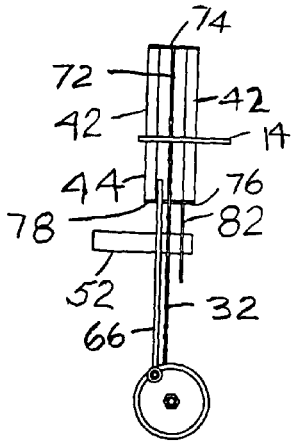
FIG. 7 is a front elevation of the saw guard system shown in FIGS. 5 and 6.
Figure 8:
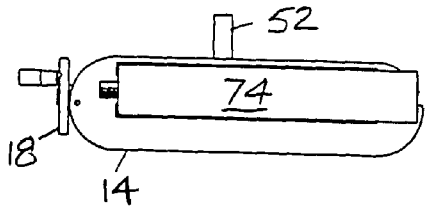
FIG. 8 is a top view of the saw guard system shown in FIGS. 5, 6 and 7.
Figure 11:
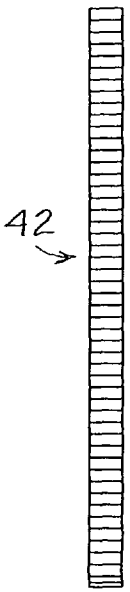
FIG. 11 is a bottom view of the top rubber saw guard shown in FIGS. 9 and 10.
Figure 10:
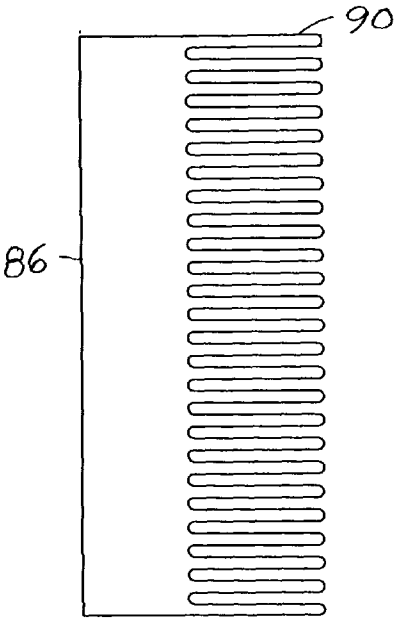
FIG. 10 is a side elevation of the top rubber saw guard shown in FIG. 9.
Figure 9:
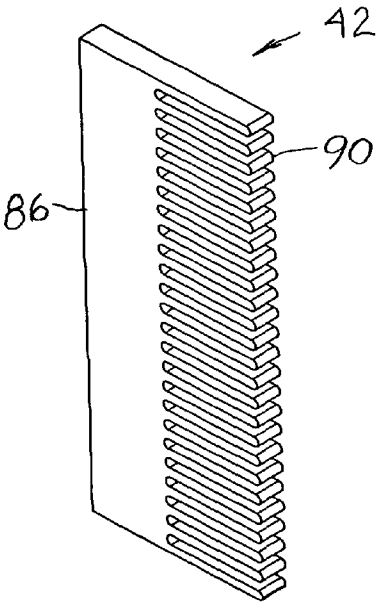
FIG. 9 is a perspective view of the top rubber saw guard.
Figure 14:
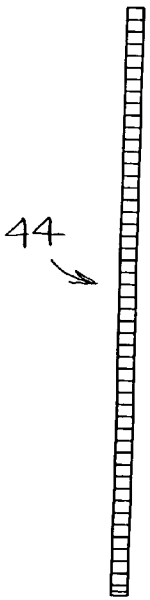
FIG. 14 is a top view of the top rubber saw guard shown in FIGS. 12 and 13.
Figure 13:
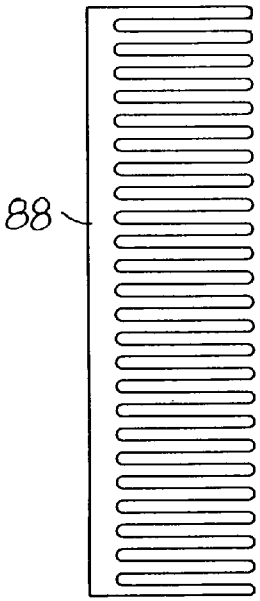
FIG. 13 is a side elevation of the bottom rubber saw guard shown in FIG. 12.
Figure 12:
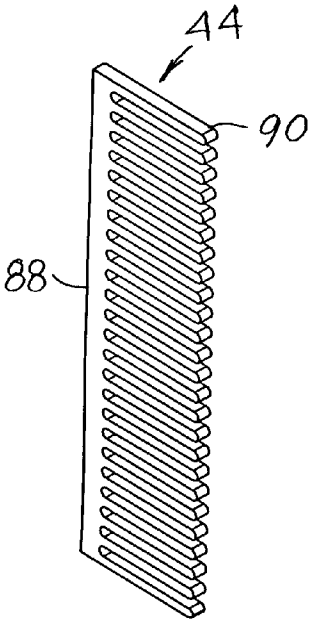
FIG. 12 is a perspective view of the bottom rubber saw guard.
Figure 16:
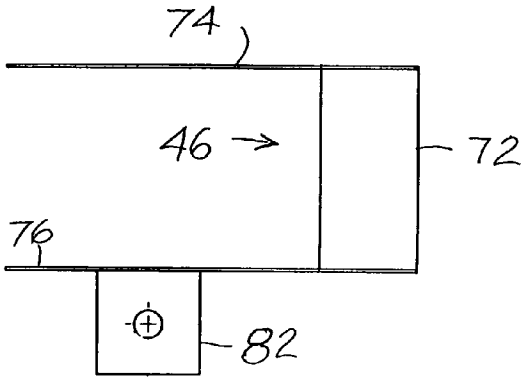
FIG. 16 is a side view of the saw guard mounting bracket shown in FIG. 15.
Figure 18:
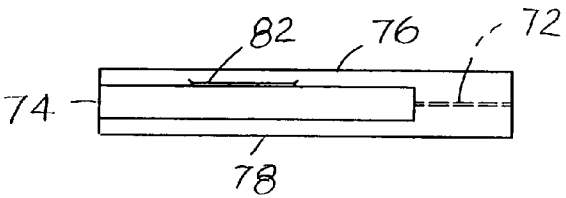
FIG. 18 is a bottom view of the saw guard mounting bracket shown in FIGS. 15, 16 and 17.
Figure 15:
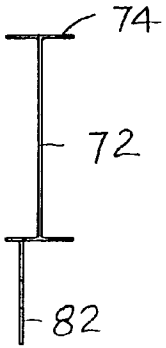
FIG. 15 is a rear elevation of the saw guard mounting bracket.
Figure 17:
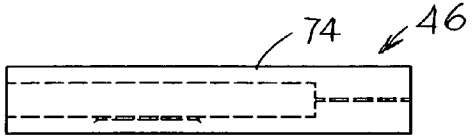
FIG. 17 is a top view of the saw guard mounting bracket shown in FIGS. 15 and 16.

FIG. 7 is a front elevation of the saw guard shown in FIGS. 5 and 6. FIG. 8 is a plan view of the saw guard shown in FIGS. 5-7.

As shown in FIGS. 7 and 9-13, the bottom finger assembly 44 is shorter than the upper finger assembly 42 due to the relative thickness of the integral backing parts 86 and 88. The actual rubber or rubber-like fingers 90 are approximately the same length.

The fingers are relatively thin in the front and back direction to allow bending, and are relatively thick in the crosswise direction to resist bending. The fingers permit bending in a rearward direction as a board is moved into the saw. Once bent, the fingers resist straightening as long as the board is in contact with the fingers. If a board were moved rearward, the increased frictional areas of the bent fingers on the board and the downward pressing resilience of the bent fingers would resist the rearward movement of the board. Thus, the fingers resist bounce-back forces imposed by the rotary saw upon the board being sawed.

In their at rest position, the fingers surround the sides of the saw blade and project in front of the saw blade.

The rigid web of the finger-mounting bracket protects the rear of the saw. The finger thickness provides substantial tactile resistance for both tactile and visual warnings as the saw blade is approached.

While the invention has been described with reference to specific embodiments, modifications and variations of the invention may be constructed without departing from the scope of the invention, which is defined in the following claims.

I claim:

1. A table saw guard apparatus comprising:

a table having a base;

a saw assembly having a circular blade;

an insert plate on the table, the insert plate having a saw blade slot for receiving the circular saw blade, two guard slots extending parallel to the saw blade slot and provided on opposite sides of the saw blade slot, and a rear slot extending rearward from the saw blade slot;

a saw guard assembly connected to the table, the saw guard assembly including a vertical web having an upper cantilevered flange plate located above the insert plate and lower split cantilevered flange plates extending along opposite sides of the circular saw blade and located beneath the insert plate, and a mounting plate extending downward from one of the lower split cantilevered flange plates, wherein in the vertical web is received in the rear slot;

flexible and resilient extensions extending vertically from two edges of the upper cantilevered flange plate and from each plate of the lower split cantilevered flange plates toward the two guard slots, and along and in front of the circular saw blade.

2. The table saw guard apparatus of claim 1, further comprising a L-shaped lever pivotally connected to the base, a rotating wheel and a screw, wherein one arm of the L-shaped lever is connected to the saw assembly and the mounting plate, the other arm of the L-shaped lever is connected to an end of the screw, and the other end of the screw is connected to the rotating wheel, wherein the rotation of the rotating wheel causes the rotation of the screw which causes the pivoting movement of the L-shaped lever which moves the saw assembly and the guard assembly up and down relative to the insert plate.

3. The table saw guard apparatus of claim 1, wherein each flexible and resilient extension has a back support and fingers extending from the back support, wherein the back support is attached to the upper cantilevered flange plate and the lower split cantilevered flange plates, and fingers extend toward the table.

* * * * *